US006668716B2

(12) United States Patent
Tsuruta et al.

(10) Patent No.: US 6,668,716 B2
(45) Date of Patent: Dec. 30, 2003

(54) PRINTING APPARATUS

(75) Inventors: Wataru Tsuruta, Yamanashi (JP); Tsuyoshi Kubota, Yamanashi-ken (JP)

(73) Assignee: Nisca Corporation, Yamanashi-ken (JP)

( * ) Notice: Subject to any disclaimer, the term of this patent is extended or adjusted under 35 U.S.C. 154(b) by 61 days.

(21) Appl. No.: 10/158,203

(22) Filed: May 31, 2002

(65) Prior Publication Data

US 2002/0178939 A1 Dec. 5, 2002

(30) Foreign Application Priority Data

May 31, 2001 (JP) ..... 2001-165560

(51) Int. Cl.[7] ..... B41D 7/00; B41J 2/01

(52) U.S. Cl. ..... 101/33; 101/229; 101/230; 101/232; 347/103

(58) Field of Search ..... 101/33, 229, 230, 101/232; 347/218, 103; 235/494, 449, 375, 493

(56) References Cited

U.S. PATENT DOCUMENTS 5,959,278 A * 9/1999 Kobayashi et al. ..... 235/449
6,094,209 A * 7/2000 Nardone et al. ..... 347/171
6,236,420 B1 * 5/2001 Matsuzaka ..... 347/170
6,249,303 B1 * 6/2001 Mochizuki et al. ..... 347/222
6,341,860 B1 * 1/2002 Harris ..... 347/103
6,595,631 B2 * 7/2003 Tanikawa et al. ..... 347/103

FOREIGN PATENT DOCUMENTS

| | | |
|---|---|---|
| JP | 08-058124 | 3/1996 |
| JP | 09-131930 | 5/1997 |
| JP | 11-263032 | 9/1999 |

* cited by examiner

*Primary Examiner*—Andrew H. Hirshfeld
*Assistant Examiner*—Marissa Ferguson
(74) *Attorney, Agent, or Firm*—Kanesaka & Takeuchi

(57) ABSTRACT

A printing apparatus includes a card transport path composed of the first card transport path for forming an image to a card using a direct transfer method, and the second card transport path composed of a card transport path for transferring an image from an intermediate transfer sheet to the card. An image forming portion is arranged on the first card transport path for forming the image on the card or the intermediate transfer sheet. A transfer portion is arranged to the second card transport path for transferring the image from the intermediate transfer sheet to the card. The first card transport path and the second card transport path intersect while the printing apparatus can switch between the direct transfer method and the indirect transfer method.

12 Claims, 8 Drawing Sheets

PRINTING APPARATUS

BACKGROUND OF THE INVENTION AND RELATED ART STATEMENT

This invention relates to a printing apparatus for printing a variety of information such as an image and a character to a recording medium, such as a card, and more particularly to a printing apparatus that is capable of switching printing methods according to characteristics of the recording medium or the information that is to be recorded.

Conventionally, a thermal transfer printing apparatus has been used to record a desired image or a character on a card recording medium such as a credit card, a cash card, a license card or an ID card by thermally transferring with a thermal head via a thermal transfer film. As an example, in Japanese Patent Publication (TOKKAI) No. 09-131930, a printing apparatus using a direct transfer method has been disclosed. The apparatus directly transfers an image and a character to a recording medium via a thermal transfer film. This method has an advantage of attaining a high quality image due to thermal sublimate ink. However, a recording medium needs to have a receptive layer on its printing surface to receive the ink. Therefore, only limited recording medium can be used, or the receptive layer needs to be formed on the surface of a recording medium.

Generally, a card made of a polyvinyl chloride (known as a PVC card) has been widely used as the recording medium that can receive the thermal sublimate ink. However, since the PVC card generates toxic substances when burned, recently it has been tried to switch to a card made of a polyethylene terephthalate (also known as a PET card). However, since the PET card is made of a crystalline polymer, it is difficult to apply not only thermal sublimate printing, but also embossing. Thus, when it is necessary to emboss a surface of the recording medium, the PVC card needs to be used.

Furthermore, in recent years, a new type of card media such as an IC card, which embeds an IC chip or antenna inside, has been used in a variety of fields. Because of the embedded element, this type of card has an uneven surface, resulting in a printing problem.

In Japanese Patent Publication (TOKKAI) No. 08-58124, a printing apparatus using an indirect transfer technology, in which an image is transferred to an intermediate transfer medium once then transferred to a final recording medium, has been disclosed to solve the above problem. According to this method, it is possible to overcome the problems such as limited recording medium related to the receptive layer or the issue of printing on an uneven surface of the recording medium. Furthermore, this method makes it easier to print an image on an entire surface of the card medium as opposed to the direct transfer method. However, it is necessary to use the intermediate transfer medium, resulting in higher operating costs and longer time to print than the direct transfer method.

In Japanese Patent Publication (TOKKAI) No. 11-263032, an image forming portion for forming an image on a belt-shaped transfer sheet (an intermediate transfer film) is disposed at an upper portion, and a retransfer portion for re-transferring the image transferred to the transfer sheet to a card as the received image is disposed at lower portion. When the image is formed on the transfer sheet, the sheet is transported in a vertical direction with respect to the apparatus. While the card is being transported in a horizontal direction after passing a sheet return path, the image is re-transferred to the card.

However, in the indirect transfer method, it is common to arrange a transfer device for transferring an image to the intermediate transfer film and a re-transfer device for re-transferring an image to the recording medium in series in a direction along the transport path of the recording medium where an image is re-transferred to a surface of the recording medium from the intermediate transfer film. Therefore, a recording medium supply portion for supplying a blank card (a card with no print) and a recording medium discharge portion for discharging the card after the printing process need to be arranged at both ends along the recording medium transport path, resulting in a larger overall apparatus. To meet minimum volume requirement, an apparatus tends to have an elongated rectangular shape with very limited flexibility in design.

Further, in Japanese Patent Publication (TOKKAI) No. 11-263032, the image forming portion and the transfer portion are disposed at upper and lower positions to minimize a size, but it is limited to the indirect transfer method.

Therefore, it will be beneficial to provide a printing apparatus having two features; an apparatus that can switch a printing method between the direct transfer method and the indirect transfer method depending on a purpose and information relating to printing, such as surface and characteristics of the recording medium including material of the recording medium such as PVC or PET, embossed surface, embedded an IC element, and an entire surface printing; and an apparatus that has a compact size with an efficient component arrangement. It is expected for such a printing apparatus to be used more widely.

An object of the present invention is to provide a compact printing apparatus that can switch between the direct transfer method and the indirect transfer method to print, while maintaining transport performance of recording medium and a processing capacity.

Another object of the present invention is to provide a printing apparatus that can switch between the direct transfer method and the indirect transfer method to print, while keeping design freedom for a compact apparatus without becoming an elongated shape.

Further objects and advantages of the invention will be apparent from the following description of the invention.

SUMMARY OF THE INVENTION

In order to attain the aforementioned objectives, a print apparatus according to the present invention is equipped with the first recording media transport path having at least one printing device for selectively forming an image on a recording medium and an intermediate transfer medium; the second recording media transport path having a transfer device to transfer the image formed on the intermediate transfer medium to the recording medium; and a turning portion for changing a direction of the recording medium to the first recording media transport path and the second recording media transport path.

The first recording media transport path and the second recording media transport path are arranged to intersect each other, and the turning portion is arranged at the intersecting position. Thus, it is possible to arrange the first recording media transport path and the second recording media transport path in a substantially vertical state. It is also possible to arrange the first recording media transport path and the second recording media transport path in a substantially horizontal state, or to arrange either of the transport paths substantially vertically with regard to the other. Furthermore, it is acceptable to dispose a recording medium discharge outlet to discharge the recording medium at an end portion of the second recording media transport path.

Further, the apparatus is provided with an encoder portion to magnetically or electrically record on the recording medium. The turning portion is configured for supplying the recording medium to the first or the second recording media transport path and for receiving the recording medium between the first and the second recording media transport path as well as between the encoder portion. The turning portion may include the first and the second turning member to rotate or invert the recording medium. One of the first and second turning members sends the recording medium to the first or second recording media transport path and receives the recording medium between the first and second recording media transport path. The other receives the recording medium between the encoder portion. Furthermore, the first and second turning members may be linked in a vertical direction, and the printing device may be disposed in an upward direction. The transfer device may be disposed on a side direction, and the encoder portion may be disposed in a direction below the transfer device.

Also, at least an eject outlet may be arranged for ejecting the recording medium, which is detected to have a processing error during a recording process at the encoder portion. The turning portion can rotate the rejected recoding medium to discharge the same to the eject outlet.

Other objectives and features of the present invention will be clearly explained in a detailed description of the preferred embodiments below based upon provided drawings.

DETAILED DESCRIPTION OF PREFERRED EMBODIMENTS

Hereunder, preferred embodiment of the present invention will be explained with reference to the accompanied drawings.

Figure 1:
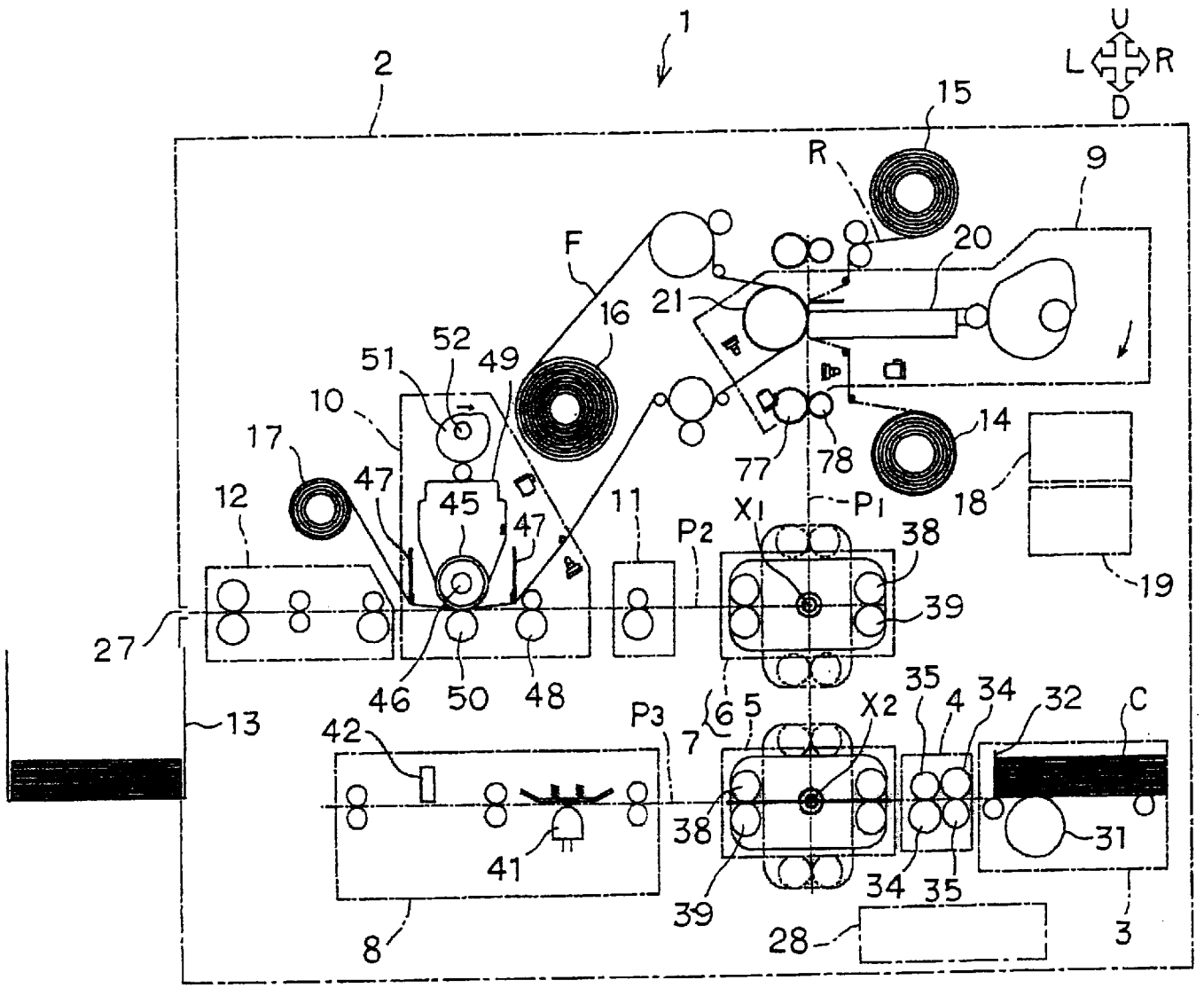
FIG. 1 is a side view showing a general configuration of a printing apparatus according to an embodiment of the present invention.

As seen in FIG. 1, according to an embodiment of the present invention, a printing apparatus 1 in a housing 2 comprises; the third card transport path P3 for recording information to a card 'C' as a recording medium; the first card transport path P1 for forming (printing) an image on the card 'C' using the direct transfer method; and the second card transport path P2 for transferring an image temporarily held on an intermediate transfer sheet 'F' as an intermediate transfer medium to the card 'C' using the indirect transfer method. The second card transport path P2 and the third card transport path P3 are disposed substantially horizontally, and the first card transport path P1 is disposed substantially vertically. The second card transport path P2 is disposed substantially parallel to the third card transport path P3 above the same. The second card transport path P2, the third card transport path P3 and the first card transport path P1 intersect each other substantially in orthogonal at intersecting points X1 and X2.

To the third card transport path P3 are arranged a card supply portion 3 for separating the blank card 'C' (no magnetically recorded or printed thereon) into a single card and sends the same to the third card transport path P3; a cleaner 4 for cleaning surface of the blank card 'C' at downstream of the card supply portion 3; the second turning portion 5 for rotating or inverting the card 'C' while nipped, rotating around the intersecting point of X2 downstream of the cleaner 4, and switching the card 'C' transport path in orthogonal to the first card transport path P1 direction; and an information recording portion 8 for writing and reading data on a magnetic strip formed on the card surface (a backside) such as those found in credit cards at downstream of the second turning portion 5.

The card supply portion 3 comprises a card stacker to store stacks of a plurality of the blank cards 'C'. A stacker side plate 32 with an opening slot to allow only one card 'C' to pass therethrough is arranged at a position facing the third card transport path P on the card stacker. To the bottom of the card stacker is pressingly arranged a kick roller 31 for feeding the bottommost blank card 'C' in a stack stored in the card stacker to the third card transport path P3.

The cleaner 4 comprises a cleaning roller 34, made of a rubber, with a sticky surface and a pressing roller 35 to press and face each other at the third card transport path P3.

The information recording portion 8 comprises an information reading and writing head 41 such as a magnetic encoder, etc., for magnetically recording information to the magnetic strip while receiving magnetic information recorded for verification (to compare the magnetic information to be recorded and the recorded magnetic information); an IC contact point 42 for accessing data electrically recorded on the IC card; and a plurality of paired rollers capable of forward and reverse rotation. The rollers receive the blank card 'C' from the second turning portion 5, transports the card in the arrow direction 'L' in FIG. 1 toward the IC contact point 42 to access data recorded in the information writing and reading head 41 and the IC card when magnetically writing and reading information to the magnetic strip, and sends the recorded cards 'C' in the arrow direction 'R' in FIG. 1 after recorded thereto by the information writing and reading head 41 and/or by the IC contact point 42 to the second turning portion 5.

On the first card transport path P1 is arranged the first turning portion 6 for rotating or inverting the card while nipping the same with the intersecting point X1 at a center to selectively switch between the first card transport path P1 and the second card transport path P2. As seen in FIG. 1 and FIG. 2, the second turning portion 5 arranged on the intersection point X2 and the first turning portion 6 arranged on the intersecting point X1 have the identical structure, and are structured to rotate or invert in synchronization by a drive portion (not shown).

Figure 2A:
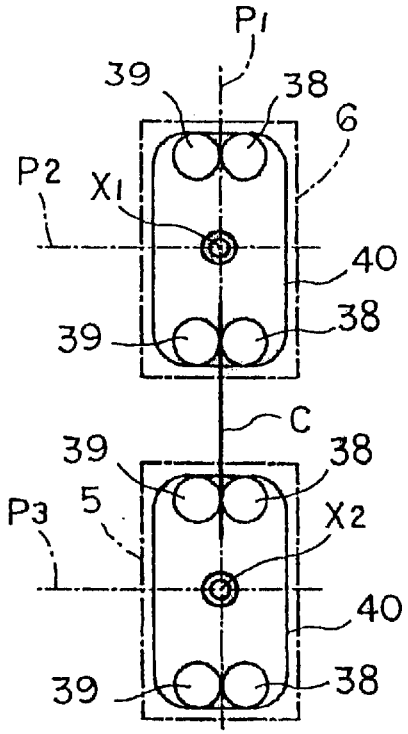
FIG. 2A is a side view showing the first turning portion and the second turning portion in a printing apparatus according to the present invention in a vertically linked state upon card reception.

The second turning portion 5 and the first turning portion 6 comprise the paired pinch rollers 38 and 39 that are capable of nipping the card 'C' after completed the magnetic recording process, and comprise the rotating frame 40 for supporting these pinch rollers to rotate or invert around the intersecting points of X1 and X2. One of the pinch rollers 38, 39 is a driving roller, and the other follows the drive of the other roller. The pinch rollers 38 and 39 press together sandwiching the third card transport path P3 (for the second turning portion 5) or the second card transport path P2 (for the first turning portion 6) when the rotating frame 40 is in a horizontal state, as shown by a solid line in FIG. 1, and press together sandwiching the first card transport path P1 when the rotating frame 40 is in a vertical state, as shown in FIG. 2A (and dotted lines in FIG. 1). Note that unit transmission sensors (not shown) to detect the card 'C' are arranged before and after the second turning portion 5 on the third card transport path P3, between the second turning portion 5 and first turning portion 6 on the first card transport path P1, between the image forming portion 9, described below, and the first card transport path P1, and between the first turning portion 6 and the paired horizontal transport rollers 11, described below, on the second card transport path P2.

When the rotating frame 40 is rotated or inverted while nipping the card between the pinch rollers 38 and 39, the pinch rollers 38 and 39 rotate together to displace the card 'C'. Thus, the rotating or turning action at the second turning portion 5 and the first turning portion 6 is driven independently from the rotation or inversion of the rotating frame 40 and the rotation of the pinch rollers 38 and 39. A unit transmission sensor (combined with a slit plate), omitted from the drawings, to detect an angle of rotation of the rotating frame 40 is disposed. In order to determine a rotational direction of the pinch rollers 38 and 39, a unit transmission sensor (combined with a semi-circular plate), also not shown in the drawings, is disposed to detect the position of either of one of the pinch rollers 38 and 39, so it is possible to freely set the rotating angle of the rotating frame 40 and to control the transport direction of the card 'C' by the pinch rollers 38 and 39.

Figure 3:
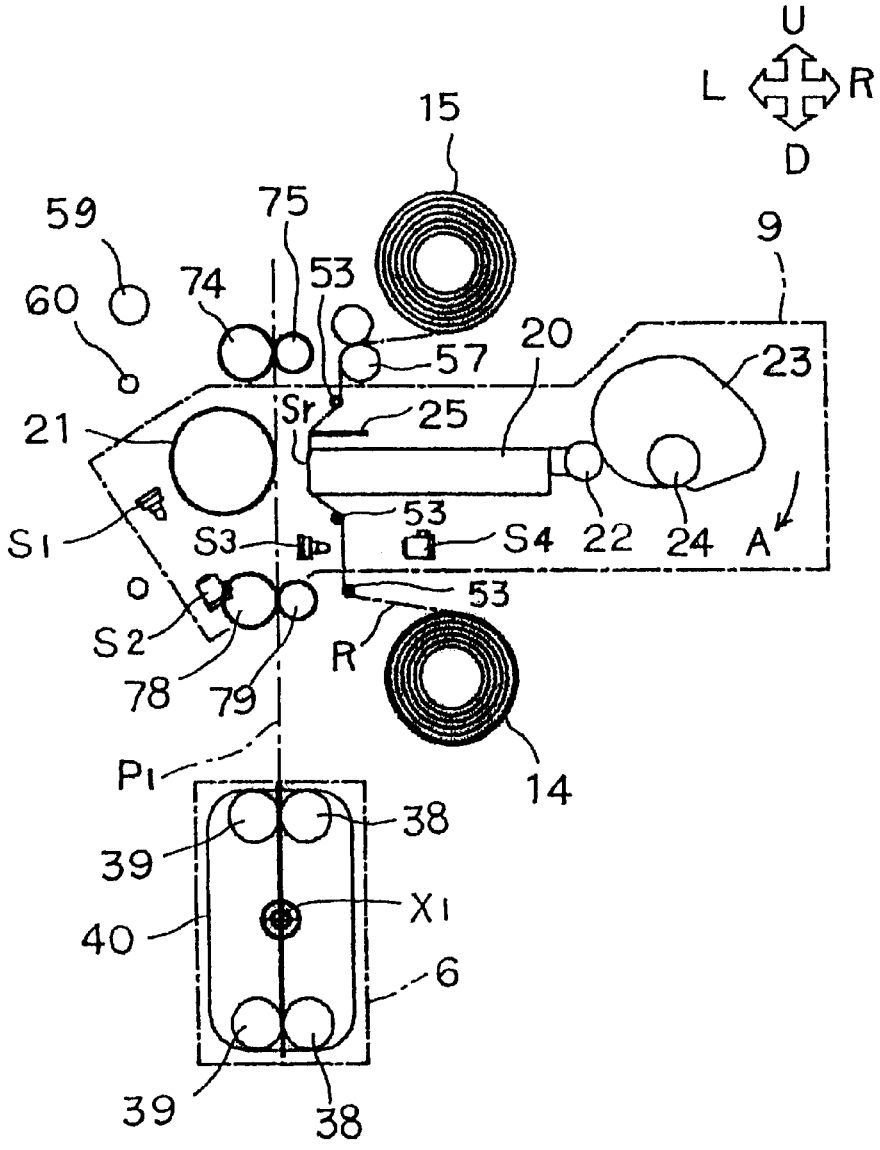
FIG. 3 is a side view near an image forming portion of a printing apparatus according to an embodiment of the present invention when performing direct printing or hologram processing using.

As shown in FIG. 3, the image forming portion 9 for forming an image on the intermediate transfer sheet, which is described below, or the card 'C' using the thermal transfer ink according to the image or character image information, is arranged at downstream of the first turning portion 6 (the direction of arrow 'U' in FIG. 3) on the first card transport path P1. The image forming portion 9 employs a configuration of a thermal transfer printer and comprises a platen roller 21 for supporting the card 'C' when printing to a surface thereof and the thermal head 20 retractably arranged to the platen roller 21. The thermal transfer sheet 'R' is interposed between the platen roller 21 and thermal head 20.

The retracting movement of the thermal head 20 to and from the platen roller 21 is performed by a thermal head sliding drive unit having a removable holder (not shown) for supporting the thermal head 20; a follower roller 22 fastened to the holder; a non-circular thermal head sliding cam 23 rotating in either direction (the arrow direction 'A' or the opposite in the drawing) around the cam shaft 24 while following an outer contour of the follower roller 22; and a spring (not shown) to press the holder against the thermal head sliding cam 23.

Figure 7A:
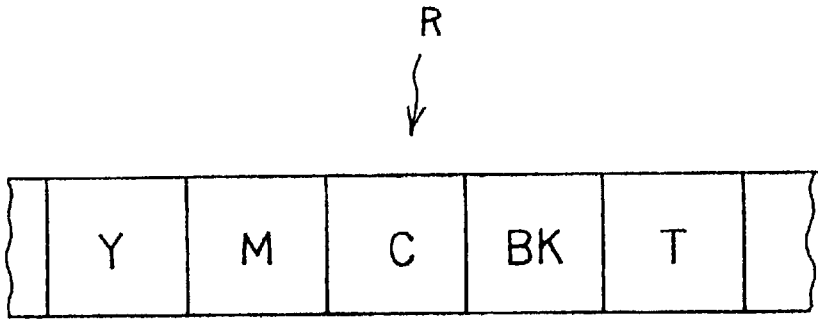
FIG. 7A is a front view showing a model of a thermal transfer sheet.

As shown in FIG. 7A, the thermal transfer sheet 'RR' sequentially carries inks, 'Y' (yellow), 'M' (magenta), 'C' (cyan) and Bk (black), on the film in a width slightly larger than a length of the card 'C'. A protective layer region 'T' for protecting the card 'C' surface is formed thereon next to the Bk (black), and this pattern is repeated along the film.

As shown in FIG. 3, the thermal transfer sheet 'R' is supplied from the thermal transfer sheet supply portion 14 where the thermal transfer sheet 'R' is wound in a roll. The thermal transfer sheet 'R' is guided by a plurality of guide rollers 53 and the guide plate 25 fastened to the holder (not shown), then is driven along with a rotation of the paired take-up roller 57 while contacting substantially the entire surface of the leading edge of the thermal head 20. Finally, the sheet is rolled on the thermal transfer sheet take-up portion 15. The thermal transfer sheet supply portion 14 and the thermal transfer sheet take-up portion 15 are disposed at both sides of the thermal head 20, and the centers thereof are mounted onto the spool shaft. In the image forming portion 9, a mark for positioning of the thermal transfer sheet RR, a light emitting element $S_3$, and a light receiving element $S_4$ for detecting the Bk portion on the thermal transfer sheet 'R' are arranged between the guide rollers 53, which are disposed between the thermal transfer sheet supply portion 14 and the thermal head 20, being away from and perpendicular to the thermal transfer sheet 'R'.

A gear (not shown) is attached to a roller shaft of the paired take-up rollers 57 at a drive side, and engages another gear with a clock plate (not shown) on the same shaft. A unit transmission sensor (not shown) is disposed near the clock plate for detecting the rotation of the clock plate to control a wound amount of the thermal transfer sheet 'RR'.

Figure 5:
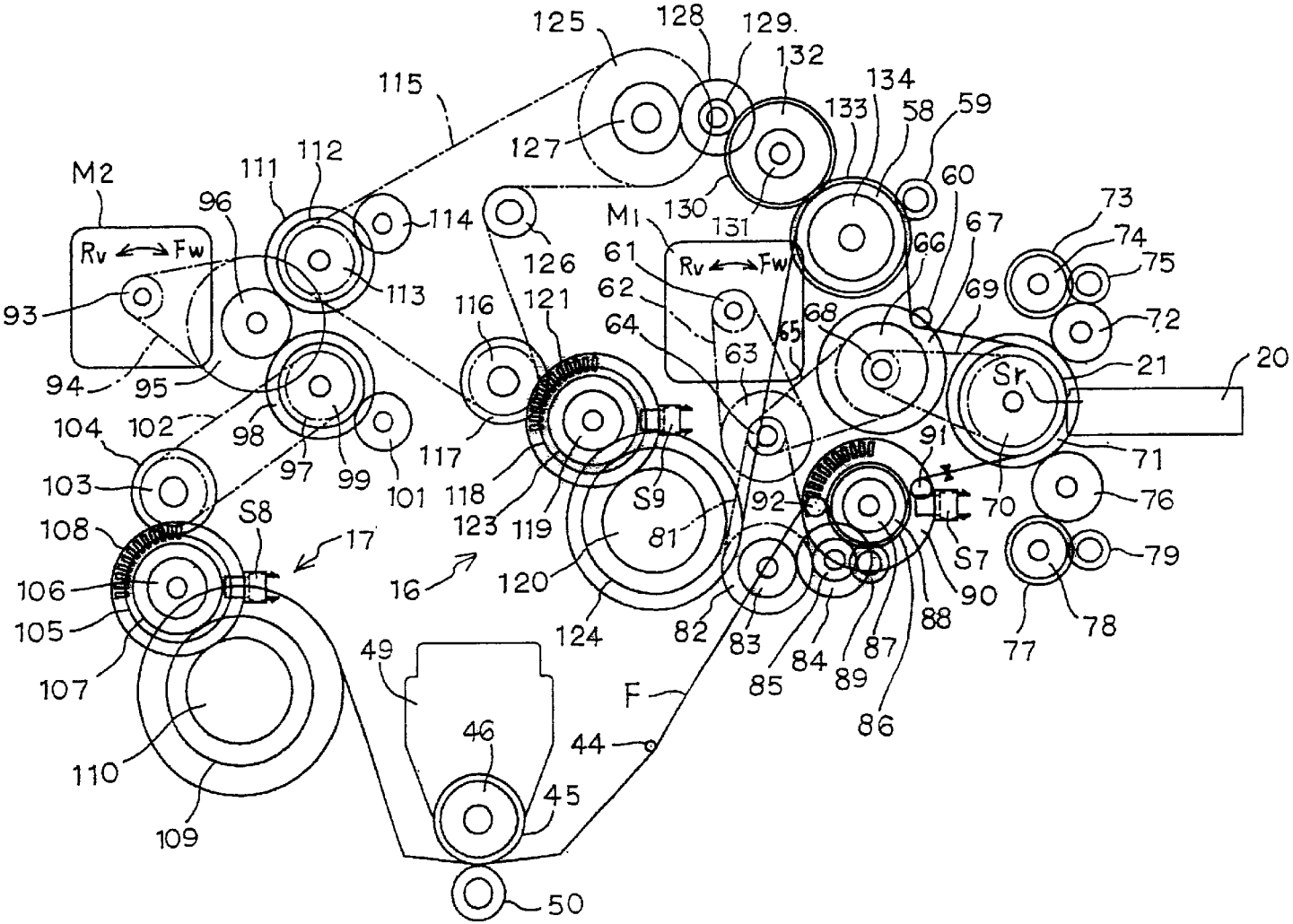
FIG. 5 is a side view showing a card transport mechanism near an intermediate transfer sheet transport mechanism and an image forming portion of a printing apparatus according to an embodiment of the present invention.

A printing position (a heating position) Sr of the thermal head 20 with respect to the card 'C' through the thermal transfer sheet 'R' is located on an outer circumference of the platen roller 21 corresponding to the first card transport path P1 (see also FIG. 5). On both sides of the image forming portion 9 are arranged a pair of a capstan roller 74 rotating a constant speed and a pinch roller 75 pressing thereto; and a pair of a capstan roller 78 and a pinch roller 79. The rollers sandwich the first card transport path P1, and rotate in synchronization to move the card 'C' in the arrow directions 'U' and 'D' in FIG. 3 with regard to the printing position Sr.

Figure 4:
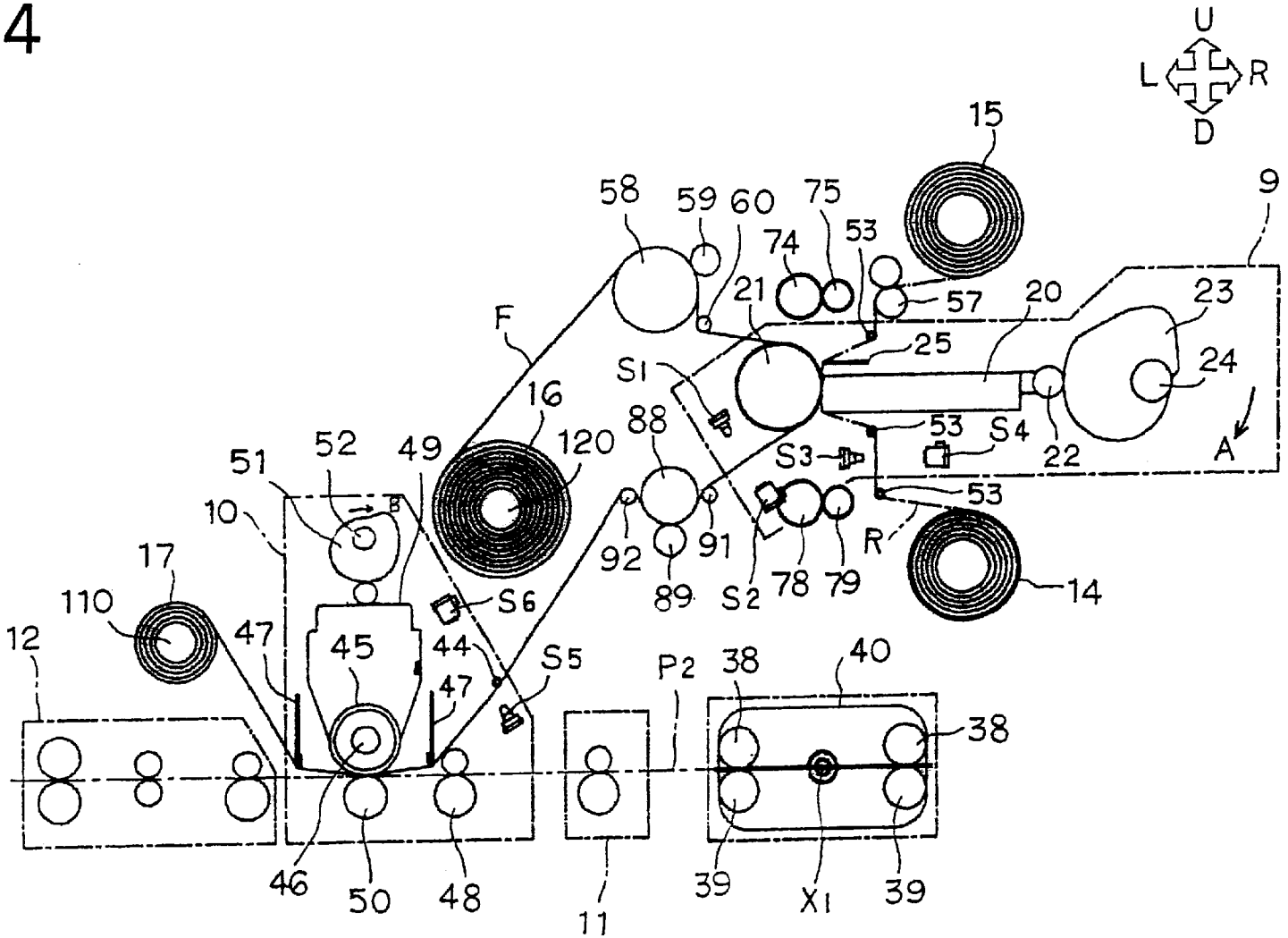
FIG. 4 is a side view of a printing apparatus according to an embodiment when performing direct printing and indirect printing.
Figure 7B:
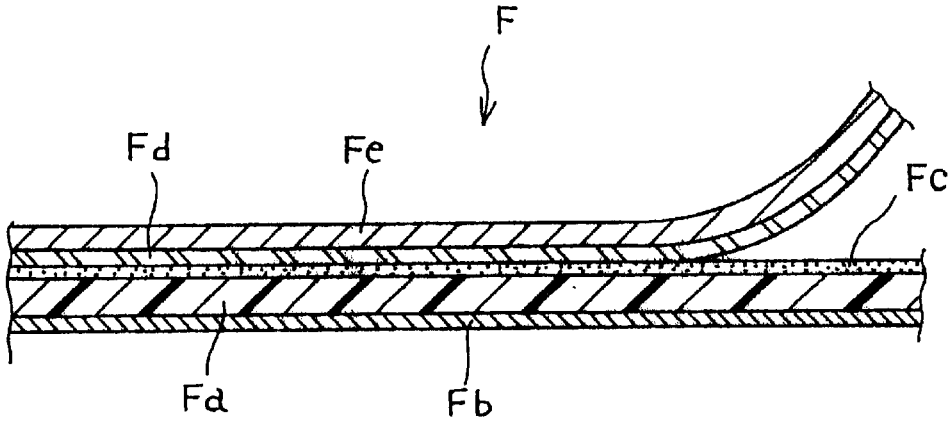
FIG. 7B is a sectional view showing a model of an intermediate transfer sheet.

As shown in FIG. 1 and FIG. 4, the intermediate transfer sheet 'F' is wound around the platen roller 21 on a surface facing the thermal head 20. As shown in FIG. 7B, the intermediate transfer sheet 'F' is a laminated film formed of a base film Fa; a back surface coating layer Fb formed on a back side of the base film Fa; a receptive layer Fe for receiving ink; an overcoat layer Fd for protecting the receptive layer surface; and a peeling film Fc. The peeling film is formed on a front side of the base film, and facilitates separation from the base film Fa by the thermally bonding the overcoat layer Fd and the receptive layer Fe. They are laminated in a order of the back surface coating layer Fb, the base film Fa, the peeling film Fc, the overcoat layer Fd, and the receptive layer Fe from the bottom. The intermediate transfer sheet 'F' is wound with the receptive layer Fe facing the thermal transfer sheet 'R' and the back coating layer Fb side contacting the platen roller 21. As shown in FIG. 3 and FIG. 4, in the image forming portion 9, a light emitting element $S_1$ and a light receiving element $S_2$ for detecting a positioning mark of the intermediate transfer sheet 'F' are arranged between the platen roller 21 and guide roller 91, being away from and perpendicular to the intermediate transfer sheet 'F'.

As shown in FIG. 4, on the second card transport path P2 at downstream of the first turning portion 6 are disposed in series a pair of horizontal transport rollers 11 to transport the card 'C' in a horizontal direction; a transfer portion 10 to transfer an image formed on the intermediate transfer sheet 'F' at the image forming portion 9; and a horizontal transport portion 12 comprising a plurality of transport rollers to transport the card 'C' to the arrow side 'L' in FIG. 4 and discharge rollers to discharge the card 'C' to outside of the frame 2.

The transfer portion 10 comprises platen roller 50 for supporting the card 'C' when transferring from the intermediate transfer sheet 'F' to the card 'C' or the hologram sheet 'H', described below, and a heat roller 45 arranged to slide with respect to the platen roller 50. Disposed in the heat roller 45 is a heating lamp 46 as a heating body to heat the intermediate transfer sheet 'F' or the hologram sheet 'H'. The intermediate transfer sheet 'F' or the hologram sheet 'H' is interposed between the platen roller 50 and heat roller 45.

The heat roller 45 is moved with respect to the platen roller 50 by such components as a holder 49 supporting the heat roller 45 to be detachable; a follower roller 43 fastened to the holder 49; a non-circular heat roller lifting cam 51 rotating in a direction (a direction of arrow B in FIG. 4) around a cam shaft 52 while contacting an outer surface of the follower roller 43; and a spring (not shown) disposed in the holder 49 for pressing the holder 49 against the heat roller lifting cam 51.

The intermediate transfer sheet 'F' is supplied from the intermediate transfer sheet supply portion 16 where the intermediate transfer sheet 'F' is wound in a roll. The intermediate transfer sheet 'F' is guided through such components as a transport roller 58 accompanied by a follower roller 59; a guide roller 60; the platen roller 21; a guide roller 91; a back-tension roller 88 for applying a tension to the intermediate transfer sheet 'F' along with a pinch roller 89; a guide roller 92; a guide roller 44; a guide plate 47, which is disposed between the guide roller 44 and the heat roller 45 and fixed to a frame constituting the transfer portion 10. When transferring, the card 'C' is sandwiched between the platen roller 50 and heat roller 45 on the second card transport path P2 and the intermediate transfer sheet 'F' is taken up by the intermediate transfer sheet take-up portion 17 that takes up the intermediate transfer sheet 'F'. Furthermore, a pair of transport rollers 48 pressing together is disposed in the transfer portion 10 to transport the card 'C' on the second card transport path P2 in the arrow direction 'L' in FIG. 4, sandwiching the second card transport path P2 at downstream of the paired horizontal transport rollers 11 and upstream of the platen roller 50. Furthermore, in the image forming portion 10, a light emitting element $S_5$ and a light receiving element $S_6$ are arranged on both sides of the intermediate transfer sheet 'F' between the guide roller 44 and guide plate 47 for detecting a positioning mark of the intermediate transfer sheet 'F'.

As seen in FIG. 5, in a region defined by the housing 2 and the first and second card transport paths P1, P2 in FIG. 1, a drive mechansim is arranged with a reversible drive pulse motor M1 and a reversible drive pulse motor M2 as a driving source. A timing pulley 61 (hereinafter referred to as simply the pulley) is fixed to a motor shaft of the pulse motor M1. An endless timing belt 62 (hereinafter referred to as simply the belt) is extended between the pulley and a pulley 63. A pulley 64 having a diameter smaller than that of the pulley 63 is fixed to the pulley 63.

A belt 65 is trained between the pulley 64 and a pulley 66. A solenoid clutch 67 is attached to a shaft of the pulley 66. The solenoid clutch 67 interlocks a rotational drive of the pulley 66 to a pulley 68 fixed to a shaft of the solenoid clutch 67 when an image is formed on the intermediate transfer sheet 'F' by the thermal head 20. The pulley 70 is fixed to the same shaft as the platen roller 21, and the belt 69 is trained between the pulley 68 and the pulley 70. Furthermore, the gear 71 having a diameter greater than the platen roller 21 engages a shaft of the platen roller 21. To the gear 71 is meshed gears 72 and 76. The gear 72 meshes with a gear 73 having the capstan roller 74 that presses against a pinch roller 75 on the same shaft. The gear 76 engages a gear 77 comprising a capstan roller 78 that presses against a pinch roller 79 on the same shaft.

Also, another belt 81 is trained to the pulley 64 for transmitting a rotational drive to the pulley 82. A gear 83 is fixed to a shaft of the pulley 82 to engage a gear 84. A gear 85 having a diameter smaller than that of the gear 84 is fixed to a shaft of the gear 84 to engage the gear 86. A torque limiter 87 is fixed to a shaft of the gear 86 so that a rotational drive force is transmitted to a back-tension roller 88 via the torque limiter 87. A pinch roller 89 is pressed against the back-tension roller 88. A clock plate 90 is fixed to a common shaft to the back-tension roller 88. As described later, when the intermediate transfer sheet 'F' is transported in a reverse direction, the back-tension roller 88 rotates in synchronization with the intermediate transfer sheet 'F'. A unit transmission sensor $S_7$ is disposed near the clock plate 90 to detect the rotation of the clock plate 90 to control a transport amount of of the intermediate transfer sheet 'F'.

A pulley 93 is fixed to a motor shaft of the pulse motor M2. A belt 94 is trained between the pulley 93 and a pulley 95. A gear 96 is fixed to a shaft of the pulley 95.

A one-way gear 97 engages the gear 96, and is fixed to a shaft that transmits a drive from the gear in the counterclockwise rotation and becomes free in the clockwise rotation (freely rotates). A gear 98 and a pulley 99 are fixed to a shaft of the one-way gear 97, and the gear 98 engages a one-way gear 101 that becomes free in the clockwise rotation and is locked in the counterclockwise rotation. A belt 102 is trained between the pulley 99 and a pulley 103. A gear 104 is fixed to a shaft of the pulley 103, and the gear 104 engages a gear 105. A torque limiter 106 is attached to a shaft of the gear 105 for transmitting a rotational drive to a gear 107 via the torque limiter 106. A clock plate 108 is fixed to a shaft same as that of the gear 107. The gear 107 engages a gear 109 that is fixed to a take-up spool shaft 110 to take up the intermediate transfer sheet 'F'. A unit transmission sensor $S_8$ is disposed near the clock plate 108 to detect the rotation of a take-up spool shaft 110 via the rotation of the clock plate 108 as well as to detect any breakage of the intermediate transfer sheet 'F' by monitoring the rotation of the take-up spool shaft 110.

Also, the gear 96 engages a one-way gear 111 that is fixed to a shaft. The shaft transmits the drive from the gear 96 in the counterclockwise rotation, and becomes free in the clockwise rotation. A gear 112 and a pulley 113 are fixed to a shaft of the one-way gear 111, and the gear 112 engages a one-way gear 114 that becomes free in the counterclockwise rotation and is locked in the clockwise rotation. A belt 115 is trained between a pulley 113, a pulley 116 and a pulley 125. To maintain a constant tension on the belt 115, a tension roller 126 is disposed between the pulley 116 and the pulley 125 that are connected by the belt 115. A gear 117 is fixed to a shaft of the gear 116, and engages the gear 118. A torque limiter 119 is fixed to a shaft of the gear 118 for transmitting a rotational drive to a gear 123 via the torque limiter 119. A clock plate 121 is fixed to a shaft same as that of the gear 123. The gear 123 engages the gear 124 that is fixed to the supply spool shaft 120 to supply the intermediate transfer sheet 'F'. A unit transmission sensor $S_9$ is disposed near the clock plate 121 to detect the rotation of the supply spool shaft 120 via the rotation of the clock plate 121 as well as to detect any breakage of the intermediate transfer sheet 'F' by monitoring the rotation of the supply spool shaft 120. The intermediate transfer sheet supply portion 16 is mounted to the supply spool shaft 120, and the sheet take-up portion 17 is mounted to the take-up spool shaft 110.

Also, the drive from the pulley 113 is transmitted to the pulley 125 via the belt 115. A gear 127 is fixed to the gear 125 shaft, and engages a gear 128. The drive is transmitted to a gear 130 via a gear 129 disposed on a shaft same as that of the gear 128. A solenoid clutch 131 is fixed to a shaft of the gear 130. The solenoid clutch 131 interlocks a rotation drive of the gear 130 to the gear 131 via a gear 132 fixed to a shaft of the solenoid clutch 131 only when the intermediate transfer sheet 'F' (Rv) is rewound (when an image is transferred to the intermediate transfer sheet 'F' by the thermal head 20). A torque limiter 134 is fixed to a shaft of the gear 133, and a rotational drive is transmitted via the torque limiter 134 to the transport roller 58 to transport the intermediate transfer sheet 'F'. Note that when the aforementioned solenoid clutch 131 drive is interlocked, the supply spool shaft 120, the platen roller 21 and the transport roller 58 transport the intermediate transfer sheet 'F' in different speeds. The speeds are set be an order of the supply spool shaft 120, the transport roller 58, and the platen roller 21 from fast to slow. Regarding the torque control, the torque is set to be an order of the platen roller 21, the transport roller 58, and the supply spool shaft 120 from large to small.

The rotational direction of the pulse motor M2 switches a direction of the intermediate transfer sheet 'F' between a forward (Fw) and a reverse (rewind) (Rv). When the image is transferred on the intermediate transfer sheet 'F' while rewinding (Rv), the transport speed of the intermediate transfer sheet 'F' by the supply spool shaft 20, the platen roller 21 and the back-tension roller 88 is set to be an order of the supply spool shaft 120, the platen roller 21, the back-tension roller 88 from fast to slow. For this reason, when the intermediate transfer sheet 'F' is separated from the thermal head 20 and is transported, the drive is cut by the solenoid clutch 67 to prevent slackening of the intermediate transfer sheet 'F'. Note that the transfer direction of the intermediate transfer sheet 'F' at this time is in the feed direction from the supply spool shaft 120 to the back-tension roller 88.

Figure 6:
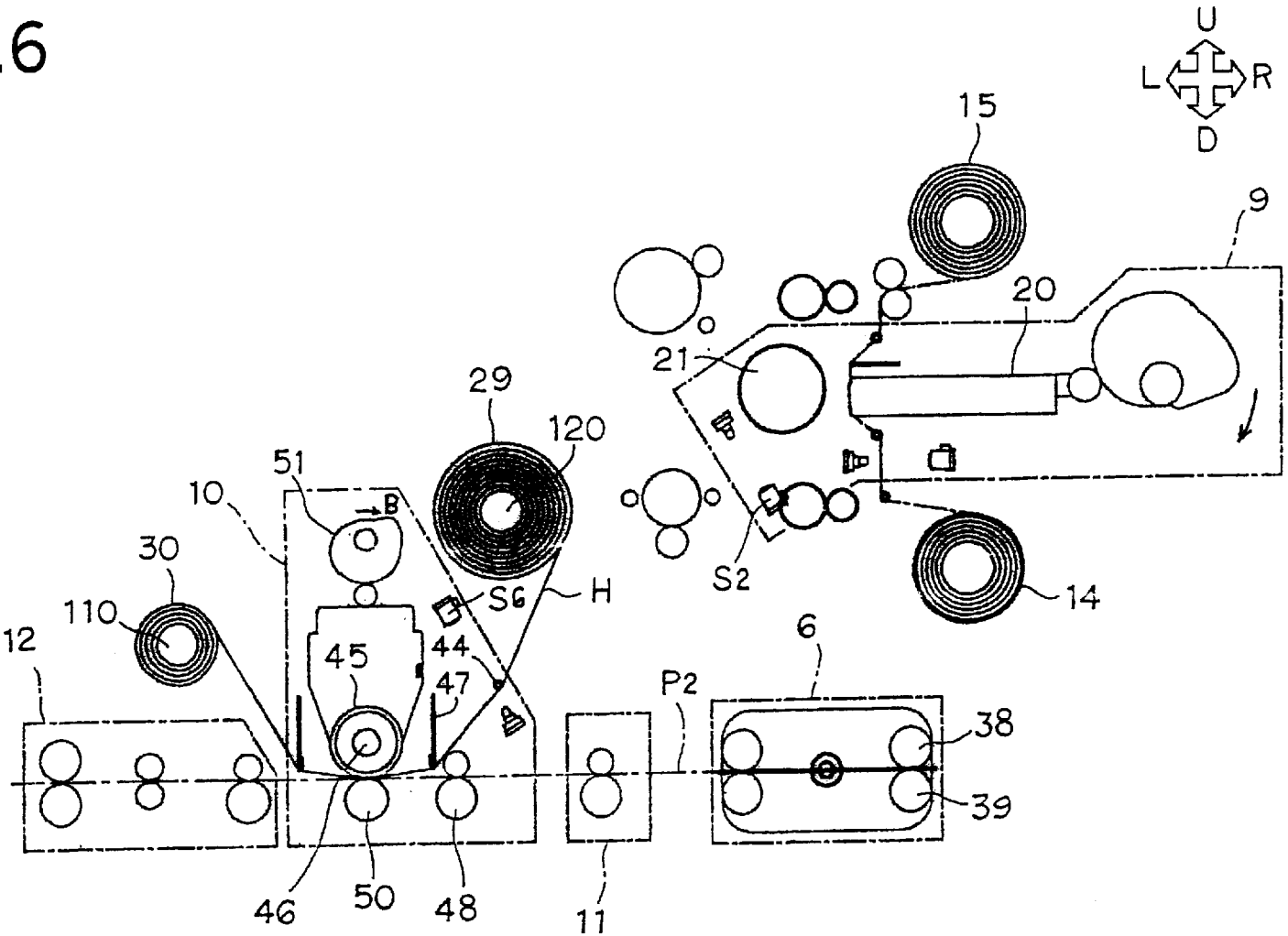
FIG. 6 is a side view of a printing apparatus according to an embodiment when performing hologram processing.

As shown in FIG. 6, in the printing apparatus 1 according to the present embodiment, the hologram sheet 'H' can be manually mounted instead of the intermediate transfer sheet 'F'. In that case, the intermediate transfer sheet supply portion 16 and the intermediate transfer sheet take-up portion 17 are removed from the supply spool shaft 120 and the take-up spool shaft 110. Rolls of the hologram sheet supply portion 29 and the hologram sheet take-up portion 30 are mounted to the supply spool shaft 120 and the take-up spool shaft 110 and the hologram sheet 'H' is trained. The hologram sheet 'H' comprises the same layered structure as the intermediate transfer sheet 'F' shown in FIG. 7B. However, one difference is that it has a preformed hologram layer instead of the reception layer.

As can be seen in FIG. 1, on a line to the arrow direction 'L' extended from the card transport path P in the frame 2, a discharge outlet 27 is disposed to discharge the card 'C' to outside of the frame 2 after printing. A detachable stacker is attached to the frame 2 below the discharge outlet 27 for stocking a stack of the card 'C'. Note that between the horizontal transport portion 12 and the discharge roller 27 is arranged a unit transmission sensor (not shown). Furthermore, the card may be damages if it is found to have an erroneous writing data at the information recording portion 8 or errors generated at the image forming portion 9 or the transfer portion 10. An eject outlet 28 is formed to eject the damages card 'C', by rotating the second turning portion 5 to an oblique direction between the arrow 'D' and the arrow 'R' shown in FIG. 1, in the downward direction along the oblique direction. To the eject outlet 28, it is also acceptable to mount a defective card receptacle to temporarily hold such a defective card.

In the frame 2, the printing apparatus 1 is provided with a power supply unit 18 for converting a commercial AC power to a DC power to drive and operate each mechanism and control unit; the control unit 19 for controlling an entire operation of the image transfer apparatus 1; and a touch panel (not shown) disposed on the frame 2 for displaying a status of the printing apparatus 1 according to the information from the control unit 19, and allowing an operator to input instructions to the control unit 19.

The control unit 19 includes a CPU block for processing the printing apparatus 1. The CPU block is composed of a CPU for operating under a fast clock speed as a central processing unit, a ROM for storing control instructions for the printing apparatus 1, a RAM working as a work area of the CPU, and an internal bus for connecting these components together.

An external bus is connected to the CPU block. To the external bus are connected a touch panel display operation control portion for controlling instructions and displays of the touch panel; a sensor control portion for controlling a signal from each of the sensors; a actuator control unit for controlling a motor driver to output a drive pulse to each of the motors and an electrical clutch; an thermal head control unit for controlling thermal energy of the thermal head 20; an external I/O interface for communicating between an external computer and the printing apparatus 1; and a RAM for storing image information for printing to the card 'C'. The touch panel display operation control unit, the sensor control unit, the actuator control unit and the thermal head control unit are connected to the touch panel, the sensors including S1 to S9, the motor drivers including the motor drivers of M1 and M2, and the thermal head 20, respectively.

Next, operations of the printing apparatus 1 according to the embodiment of the invention will be explained. Assume that the RAM already stores the image information received from an external computer via the external I/O interface. Via the touch panel or the external computer, the card 'C' already stores such printing information regarding use whether either or both the direct transfer method or indirect transfer method; transfer to whether one side or both sides of the card C; what the image information is; whether perform over-coating using the hologram sheet 'H' for the direct transfer; the recording information to be written to the magnetic stripe or IC chip; and the information relating to recording and printing such as the card 'C' dimension.

The following will describe two operations.

(1) Operations of the printing apparatus 1 when an operator prints on both sides of the card 'C' using the direct transfer method and applies the hologram processing only on the front side (the side without a magnetic strip).

(2) Operations of the printing apparatus 1 when the operator prints on the back side of the card 'C' using the direct transfer method and prints on the front side using the indirect transfer method.

(1) Direct transfer on both sides (hologram processing on the front surface):

First, when the CPU in the control unit 19 (hereinafter referred to CPU) is initialized, the intermediate transfer sheet 'F' or the hologram sheet 'H' is wound by more than one image. If the light reception sensor S2 detects the ribbon position detection mark during that operation, it is determined that the intermediate transfer sheet 'F' has been mounted. If the light emitting sensor S2 does not detect the ribbon position detection mark, it is determined that the hologram sheet 'H' has been mounted. Also, one of the spool shaft 110 and the spool shaft 120 is cut off from by the action of the clutch (not shown), when the other is taking up the sheet. By monitoring sensor S8 or S9, it is possible to detect if the intermediate transfer sheet 'F' or the hologram sheet 'H' is not mounted or is broken. After this step, the amount taken up is returned to complete the ribbon identification process.

In a state shown in FIG. 4, a detection signal from the light reception sensor S6 determines that either the intermediate transfer sheet 'F' or the hologram sheet 'H' is set (either sheet is mounted and is not broken). The intermediate transfer sheet 'F' is detected by the light emitting sensor S2, so that processing for a hologram is not possible. When it is determined that processing is not possible, the touch panel switches to display from the hologram sheet 'H' to the intermediate transfer sheet 'F' and idles until the opening and closing door is opened and closed once. It is determined again after the opening and closing door is opened and closed again. If the light emitting sensor S6 detects neither the intermediate transfer sheet 'F' nor the hologram sheet 'H', the touch panel displays that the intermediate transfer sheet 'F' or the hologram sheet 'H' has not been mounted or been broken. The printing apparatus idles until the opening and closing door is opened and closed once. After opening and closing once, it tries to detect the intermediate transfer sheet 'F' or the hologram sheet 'H'. In a state shown in FIG. 6, the light emitting sensor S6 detects either the intermediate transfer sheet 'F' or the hologram sheet 'H'. Since the light emitting sensor S6 detects the hologram sheet 'H' (not the intermediate transfer sheet F), it is determined that hologram processing is possible.

In the hologram processing, it drives the card supply portion 3 arranged on the third card transport path P3, the cleaner 4, and the second turning portion 5. The blank card 'C' at the card supply portion 3 is transported in the arrow direction 'L' in FIG. 1. In other words, the kick roller 31 on the card supply portion 3 rotates to feed the lowermost blank card 'C' on the card stacker to the third card transport path P3. The cleaning roller 34 on the cleaner 4 cleans both sides of the blank card 'C'. When a leading edge of the blank card 'C' is detected by the unit transmission sensor (not shown) arranged between the second turning portion 5 and the cleaner 4, the kick roller 31 on the card supply portion 3 stops rotating. The blank card 'C' is stopped after transported from the unit sensor to the second turning portion 5 by the predetermined number of pulses. The second turning portion 5 in a horizontal state nips the blank card 'C' (See FIG. 1).

Then, recording information is sent to the information recording portion 8, and the blank card 'C' is received between the second turning portion 5 and the information recording portion 8. The information recording portion 8 starts to drive a plurality of transport rollers in the transport direction of the blank card 'C' based on an instructions from the CPU. The CPU stops the pinch rollers 38 and 39 on the second turning portion 5, which sent the card 'C' to the information recording portion 8, based on a signal from the unit transmission sensor (not shown) arranged between the second turning portion 5 and the information recording portion 8. The information recording portion 8 writes magnetic data and/or IC data based on the recording information from the control portion 19 to the blank card 'C'. The CPU receives a verification from the information recording portion 8 to confirm successful writing. Then, the pinch rollers 38 and 39 on the second turning portion 5 are driven to receive the card 'C', and an instruction to discharge the card 'C' is sent to the information recording portion 8. The CPU stops the rotation of the pinch rollers 38 and 39 on the second turning portion 5 according to the signal from the unit transmission sensor (not shown) arranged between the second turning portion 5 and the information recording portion 8. The blank card 'C' is stopped after transported from the unit sensor to the second turning portion 5 by the predetermined number of pulses. The second turning portion 5 in a horizontal state nips the blank card 'C' (See FIG. 1). In a case that the verification from the information recording portion 8 confirms a writing error, the second turning portion 5 rotates to an oblique direction between the arrows 'D' and 'R' in FIG. 1. The pinch rollers 38 and 39 sends a defective card 'C' toward the eject outlet 28 disposed downward in the oblique direction.

When the verification from the information recording portion 8 confirms correct writing (no writing errors), the CPU rotates the second turning portion 5 by 90 degree (along with the first turning portion 6) (See FIG. 2A.). Then, the pinch rollers 38 and 39 on the second turning portion 5 are driven to send the card 'C' in the arrow direction 'U' in FIG. 1, and the pinch rollers 38 and 39 on the first turning portion 6 are driven in the same way. The card 'C' is received between the second turning portion 5 and the first turning portion 6 as shown in FIG. 2A. The CPU stops the pinch rollers 38 and 39 on the first turning portion 6 and the second turning portion 5 after the card 'C' is detected by the unit transmission sensor (not shown) arranged between the second turning portion 5 and the information recording portion 1 after sending the card by the predetermined number of pulses. While the card 'C' is nipped in the first turning portion 6 (as shown in FIG. 3), the CPU starts the pulse motor M1 and interlocks the solenoid clutch 67. The platen roller 21, the capstan roller 74 and the capstan roller 78 start to rotate.

The thermal head 20 is away from the platen roller 21 (see FIG. 3) and the thermal transfer sheet 'R' is fed by a predetermined distance so that, for example, a starting edge of 'Y' (yellow) reaches the printing position Sr. This control can be performed by, for example, detecting a trailing edge of the Bk (black) portion of the thermal transfer sheet 'R' by the light emitting sensor S4, and determining a predetermined regular interval from a trailing edge of Bk (black) to a starting edge of 'Y' (yellow) on the thermal transfer sheet 'R'. The interval can be determined through rotation of the clock plate (not shown) disposed near the paired take-up rollers 57 by the unit transmission sensor (not shown).

The pinch rollers 38 and 39 on the first turning portion 6 stop rotating at a point where the unit transmission sensor (not shown) arranged between the first turning portion 6 and the image forming portion 9 detects the trailing edge of the card 'C'. The card 'C', inserted into the image forming portion 9, is transported in the arrow direction 'U' shown in FIG. 3 by the first turning portion 6, capstan roller 78 and the pinch roller 79 over the first card transport path P1. The CPU transports the card 'C' in the arrow direction 'U' to the printing starting position by the predetermined number of pulses, after the unit sensor arranged between the capstan roller 78 and the thermal head 20 detects the leading edge of the card 'C'. The card 'C' is transported to the printing position, then the thermal head sliding cam 23 starts to rotate. At this point, the back side of the card 'C' is supported by the platen roller 21 through the rotating action of the thermal head sliding cam 23 toward the arrow direction 'A' in FIG. 3. The front side of the card 'C' is pressed against the thermal head 20 interposed therebetween by the thermal transfer sheet 'R'.

The CPU converts the image data with respect to YMC into heat energy according to the predetermined image information. In addition to the heat energy, a fixed coefficient based on a type of card 'C' and intermediate transfer sheet 'F' is sent to the thermal head 20 as heating information. Each element in the thermal head 20 is heated according to the heating information. The pulse motor M1 drives the platen roller 21 to rotate in the counterclockwise direction. In synchronization, the thermal transfer sheet 'R' is taken-up by the thermal transfer sheet take-up portion 15, and the 'Y' (yellow) image is formed (printed) on the card 'C' by direct transfer.

After the image forming of the 'Y' (yellow) portion is completed, the CPU rotates the thermal head sliding cam 23 further in a direction opposite to the arrow 'A' in FIG. 3, and the thermal head 20 is retracted from the card. The pulse motor M1 starts a reverse drive after the thermal head 20 is retracted. The platen roller 21, the capstan roller 74, the pinch roller 75, the capstan roller 78 and the pinch roller 79 rotate in reverse, and the card 'C' is transported in the arrow direction 'D' in FIG. 3. The CPU stops the reverse drive of the pulse motor M1 after the leading edge of the card 'C' passes the unit transmission sensor (not shown) arranged between the capstan roller 78 and the thermal head 20, and the card 'C' has been transported by the predetermined number of pulses. To print the next die 'M' (magenta), the CPU drives the pulse motor M1 forward. After the leading edge of the card 'C' is detected by the unit transmission sensor (not shown) arranged between the capstan roller 78 and the thermal head 20, the CPU transports the card 'C' in the arrow direction 'U' for the predetermined number of pulses to the print starting position. During that time, the CPU feeds a small amount of the thermal transfer sheet 'R' until the leading edge of the next color 'M' (magenta) is positioned at the print starting position Sr. By rotating the thermal head sliding cam 23 further in the arrow direction 'A', the thermal head 20 is pressed against the card 'C', therebetween interposed by the thermal transfer sheet 'R'. The thermal head 20 forms the 'M' (magenta) image overlaying the previous 'Y' (yellow) on the card 'C'. The CPU repeats the processes in order to overlap images of the YMC inks on the surface of the card 'C'.

After the image forming to the card 'C' is completed, the CPU rotates the thermal head sliding cam 23 further in a direction opposite to the arrow 'A' in FIG. 3, and the thermal head 20 is retracted from the card. After the thermal head 20 is retracted, the CPU starts reverse drive of the pulse motor M1 after driving the pinch rollers 38 and 39. The card 'C' is transported in the arrow direction 'D' in FIG. 3 by the reverse rotation of the platen roller 21, the capstan roller 74, the pinch roller 75, the capstan roller 78 and the pinch roller 79. With the card 'C' nipped by the first turning portion 6, the reverse drive of the pulse motor M1 and the interlocking of the solenoid clutch 67 are stopped, and the pinch rollers 38 and 39 are stopped (shown in FIG. 3).

Figure 2B:
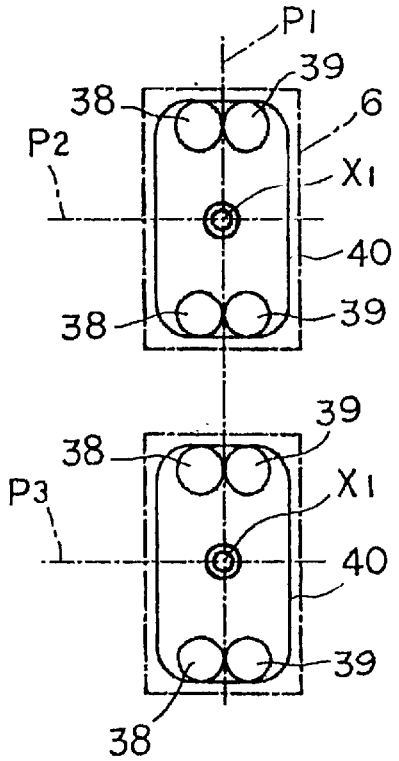
FIG. 2B is a side view showing the first turning portion and the second turning portion in a printing apparatus according to the present invention in a vertically linked state after synchronized inversion.

Next, the CPU inverts both the first turning portion 6 and the second turning portion 5 (180° rotation) as shown in FIG. 2B. The card 'C' is also reversed front to back with regard to the first card transport path P1. The CPU forms an image on the backside of the card 'C' using the method described above. Note that printing to the backside of the card 'C' often needs only one color Bk (black). In such a case, an image is formed using only Bk (black) according to the same method described above, and image forming using YMC is not performed. The CPU inverts both the first turning portion 6 and the second turning portion 5 (90° rotation) while the card 'C' is nipped. The pinch rollers 38 and 39 on the first turning portion 6 are stopped after the image forming process on the backside of the card 'C' is completed (See FIG. 6). The card 'C' moves to the second card transport path P2, where the hologram processing can be started.

The CPU drives the pinch rollers 38 and 39 on the first turning portion 6, a pair of the horizontal transport rollers 11, a pair of the transport rollers 48 and a plurality of rollers on the horizontal transport portion 12 to transport the card 'C' in the arrow direction 'L' in FIG. 6 over the second card transport path P2. The CPU stops the pinch rollers 38 and 39 when the trailing edge of the card 'C' is detected by the unit sensor (not shown) arranged between the first turning portion 6 and the horizontal transport portion 12. By transporting the card 'C' by the determined number of pulses from the unit transmission sensor (not shown) to the heat roller 45, the leading edge of the card 'C' is positioned to touch the heat roller 45. Next, the heat roller elevator cam 51 is rotated in the arrow direction 'B'. The heat roller 45 moves from a position separated from the platen roller 50 to a position contacting the platen roller 50. Note that the heating lamp 46 inside the heat roller 45 is pre-heated to reach a predetermined transfer temperature.

At this point, the platen roller 50 rotates and supports the backside of the card 'C', and the front side of the card is pushed against the heat roller 45 through the hologram sheet 'H' at the leading edge of the card 'C'. With being in this position, the card 'C' is transported in the arrow 'L' direction in FIG. 6. The peeling layer of the hologram sheet 'H' is peeled away from the base film by the heating lamp 46, and the hologram layer and overcoat layer are transferred to the card 'C' surface together. In synchronization to the transfer of the hologram layer and the overcoat layer, the hologram sheet 'H' is taken up by the hologram sheet take-up portion 30.

After the transfer of the hologram sheet 'H' to the front surface of the card 'C' according to the dimensions of the card 'C' is completed, the CPU stops the rotational drive of the pulse motor M2, and rotates the heat roller elevator cam 51 to the arrow direction 'B' again to retract the heat roller 45 from the platen roller 50. The card 'C' is transported in the horizontal transport portion 12, and is discharged to the stacker 13 through the discharge outlet 27. The CPU stops the roller on the second card transport path P2 after a predetermined period of time from when a signal is received from the unit transmission sensor (not shown) arranged between the horizontal transport portion 12 and the discharge outlet 27, and displays the number of the processed cards or that processing is completed on the touch panel.

(2) Direct transfer to the backside and indirect transfer to the front side

First, in the same way as the direct transfer to both sides of the card 'C', the CPU determines if the intermediate transfer sheet 'F' is mounted by using the detection signals from the light emitting sensors S2, S6 and the sensors S8 and S9. If it is not the case, the CPU displays a message to set the intermediate transfer sheet 'F' on the touch panel, and waits until the opening and closing door is opened and closed once. If it is the case, after forming an image on the backside of the card 'C' using the direct transfer method as described above, the first turning portion 6 is rotated by 90 degree (shown in FIG. 4) along with the second turning portion 5 while the pinch rollers 38 and 39 on the first turning portion 6 are stopped with the card 'C' nipped therebetween. Note that when forming an image using both the direct transfer method and the indirect transfer method, the intermediate transfer sheet 'F' is trained to the platen roller 21 and back-tension roller 88. The pulse motor M1 and the pulse motor M2 are driven so that the card 'C' is transported in the same direction when forming images to the backside of the card 'C' as the transport direction of the intermediate transfer sheet 'F' when forming images to the intermediate transfer sheet 'F'. The transport speed of the intermediate transfer sheet 'F' at the printing position Sr is greater than that of the card 'C'.

Next, the CPU heats ink on the thermal transfer sheet 'R' with the thermal head 20, and forms an image on the reception layer Fe of the intermediate transfer sheet 'F'. When forming the image, the pulse motor M1 is driven to rotate the platen roller 21 in the counterclockwise direction while the pulse motor M2 is driven to take-up the intermediate transfer sheet 'F' on the intermediate transfer sheet supply portion 16. In synchronization, the thermal transfer sheet 'R' is taken up on the thermal transfer sheet take-up portion 15. In other words, a positioning mark on the intermediate transfer sheet 'F' is recognized by the CPU through monitoring the light emitting sensor S2. By detecting the amount of rotation of the clock plate 90 connected to the back-tension roller 88 that rotates in both directions along with the intermediate transfer sheet F, it is determined whether the intermediate transfer sheet 'F' has been transported to the printing starting position. The thermal head 20 is positioned away from the platen roller 21, and the thermal transfer sheet 'R' is fed by a predetermined distance to a position where, for example, the starting edge of the color 'Y' (yellow) is at the printing position Sr. After the starting edge of the 'Y' (yellow) reaches the printing position Sr, the CPU rotates the thermal head sliding cam 23 further in a direction opposite to the arrow 'A' in FIG. 4, so that the thermal head 20 touches the platen roller 21 through the thermal transfer sheet 'R'. Simultaneously, the pulse motor M1 and the pulse motor M2 are driven to rotate in reverse (Rv). The image of the color 'Y' (yellow) is formed on the intermediate transfer sheet 'F'.

After the image forming of the 'Y' (yellow) to the intermediate transfer sheet 'F' is completed, the CPU rotates the thermal head sliding cam 23 to retract the thermal head 20 from the platen roller 21. By rotating the pulse motor M1 and the pulse motor M2 in the feeding direction (Fw), the take-up spool shaft 110 rotates in the counterclockwise direction and takes up the intermediate transfer sheet 'F' until the positioning mark passes the light emitting sensor S2. Next, in the same way as for the 'Y' (yellow) portion, by detecting the amount of rotation of the clock plate 90 connected to the back-tension roller 88 that rotates in both directions along with the intermediate transfer sheet F, it is determined whether the intermediate transfer sheet 'F' has been transported to the printing starting position. The thermal transfer sheet 'R' is fed by a small distance until the leading edge of the 'M' (magenta) portion reaches the printing position Sr. In the same manner as was used for the 'Y' (yellow) portion, the thermal head sliding cam 23 rotates again to push the thermal head 20 to form an image of the 'M' (magenta) portion onto the 'Y' (yellow) portion on the receptive layer FE on the thermal transfer sheet 'R'. The CPU repeats the above described processes in order to form images in layers using the YMC inks on the intermediate transfer sheet F, then retracts the thermal head 20 from the platen roller 21.

Note that since the specific heat of the base film of the intermediate transfer sheet 'F' is a lower than that of the card 'C', through the control portion 19 thermal control unit, the thermal energy applied to the thermal head 20 when forming images on the intermediate transfer sheet 'F' is set to be lower than the thermal energy applied to the thermal head 20 when directly transferring to the card 'C' (larger energy when directly transferring to the card 'C'). Calculation of the thermal energy can be performed by changing coefficients to the aforementioned thermal energy.

Next, the CPU drives the pulse motors M1 and M2 in the feeding direction (Fw) to transport the intermediate transfer sheet 'F' to the heat roller 45, which is separated from the platen roller 50 in advance, according to the amount of rotation of the clock plate 90 detected by the unit transmission sensor S7. Note that by monitoring the light emitting sensor S6 during the transport, the positioning mark on the intermediate transfer sheet 'F' is detected to reset the amount of transport at this point, resulting in improvement of the transport accuracy. At this time, in the same way as just described for direct transfer to both sides, the CPU drives the pinch rollers 38 and 39 on the first turning portion 6, a pair of the horizontal transport rollers 11, a pair of the transport rollers 48 and the plurality of paired rollers on the horizontal transport portion 12 to transport the card 'C' on the second card transport path P2 in the arrow direction 'L' in FIG. 4.

When the leading edge of the card 'C' touches the heat roller 45, the CPU rotates the heat roller elevator cam 51 in the arrow direction 'B' and shifts the heat roller 45 from a position separated from the platen roller 50 to a position touching the platen roller 50, then stops the heat roller elevator cam 51. At this point, the platen roller 50 rotates and supports the backside of the card 'C', and the front side of the card is pushed against the heat roller 45 through the intermediate transfer sheet 'F' at the leading edge of the card 'C'. The CPU drives the pulse motor M2 in the feeding direction (Fw). With being in this position, the card 'C' is transported in the arrow direction 'L' in FIG. 4. The peeling layer Fc of the intermediate transfer sheet 'F' is peeled away from the base film Fa by the heating lamp 46, and the receptive layer Fe and the overcoat layer Fd are transferred to the card 'C' surface together. In synchronization to the transfer, the intermediate transfer sheet 'F' is taken up by the intermediate transfer sheet take-up portion 17.

After the transfer of the intermediate transfer sheet 'F' to the front surface of the card 'C' according to the dimensions of the card 'C' is completed, the CPU stops the rotational drive of the pulse motors M1, M2, and rotates the heat roller elevator cam 51 again to retract the heat roller 45 from the platen roller 50. The card 'C' is transported in the horizontal transport portion 12, and is discharged to the stacker 13 through the discharge outlet 27.

Next, an effect of the printing apparatus 1 according to the embodiment will be explained.

The printing apparatus 1 according to the present embodiment comprises the image forming portion 9 for forming the image on the card 'C' or on the intermediate transfer sheet 'F' and the transfer portion 10 for transfer the image from the intermediate transfer sheet 'F' to the card 'C', thus it is possible to switch between the direct transfer and indirect transfer methods for printing. Furthermore, the printing apparatus 1 can cover the card 'C', which has the direct transfer image formed by the transfer portion 10, with the hologram sheet 'H'. For that reason, depending on the printing information and a variety of purposes relating to the material type of the card 'C', such as a PVC or a PET, whether it is embossed, the surface shape and characteristics of the card 'C' including the presence of IC elements, various types of printing such as whether printing is to occur over the entire surface of the card 'C', the operator can switch the printing method between the direct transfer method and the indirect transfer method. This reduces the running costs associated with printing to the card 'C'.

Further, in the printing apparatus 1, the single thermal head 20 forms the image on the card 'C' and the intermediate transfer sheet F, the single heat roller 45 transfers the image from the intermediate transfer sheet 'F' and the hologram sheet 'H' to the card 'C'. Also, when the image is formed on the card 'C' and the intermediate transfer sheet F, and the image is transferred from the intermediate transfer sheet 'F' and the hologram sheet 'H' to the card 'C', the platen roller 50 arranged to face the heat roller 45 and the platen roller 21 arranged to face the thermal head 20 are commonly used. Therefore, in the printing apparatus 1, the common parts are used for the direct transfer method, the indirect transfer method and the overcoat to lower costs without increasing the size of the printing apparatus 1.

Also, in the printing apparatus 1, the intermediate transfer sheet supply portion 16 for supplying the intermediate transfer sheet 'F' and the hologram sheet supply portion 29 for supplying the hologram sheet 'H' are commonly attached to the supply spool shaft 120. The intermediate transfer sheet take-up portion 17 for taking up the intermediate transfer sheet 'F' and the hologram sheet take-up portion 30 for taking up the hologram sheet 'H' are commonly attached to the take-up spool shaft 110. Therefore, it is possible to use the common supply mechanism for the intermediate transfer sheet 'F' and hologram sheet 'H', and the common take-up mechanism for the intermediate transfer sheet 'F' and the hologram sheet 'H', resulting in the more compact printing apparatus 1 without duplication of these mechanisms.

Further, in the printing apparatus 1, as the pulse motor M2 rotates the take-up spool shaft 110 and the supply spool shaft 120, it is possible to simplify the drive mechanisms thereby further reducing the cost. The pulse motor M1 transports the intermediate transfer sheet 'F' and the card 'C' on the transport path of the intermediate transfer sheet 'F'. The solenoid clutch 67 prevents looseness of the intermediate transfer sheet 'F'. Thus, it is possible to overprint the image using the three colors of YMC to the intermediate transfer sheet 'F', and it is unnecessary to create a separate transport drive portion near the image forming portion 9 of the card 'C'. Therefore, the cost of the printing apparatus 1 is reduced. Moreover, both of the pulse motors M1 and M2 can be driven forward and in reverse. Because the unit transmission sensor S7 detects the rotation to determine the amount that the intermediate transfer sheet 'F' in the intermediate transport path has been fed or rewound, the three colors YMC can be overlapped without any color shift.

Furthermore, in the printing apparatus 1, through the control portion 19 thermal control unit, the thermal energy applied to the thermal head 20 when forming the image on the intermediate transfer sheet 'F' is set to be lower than the thermal energy applied to the thermal head 20 when transferring to the card 'C'. The drive mechanism shown in FIG. 5 has a faster transport speed for the intermediate transfer sheet 'F' when forming the image thereto than that for the card 'C' when forming the image thereto, so it is possible to attain high quality images without lowering the printing performance, regardless of a difference in the specific heat of the card 'C' and the intermediate transfer sheet 'F'.

In the printing apparatus 1, the pulse motor M1 and the pulse motor M2 are driven so that the card 'C' is transported in the same direction when forming the image to the backside of the card 'C' as the transport direction of the intermediate transfer sheet 'F' when forming the image to the intermediate transfer sheet 'F'. Thus, the capstan rollers 74 and 78 for transporting the card 'C' near the image forming portion 9 can be compactly arranged closer to the platen roller 50, further reducing the size of the image forming portion 9.

In the printing apparatus 1, the image forming portion 9 is arranged in a position intersecting the first card transport path P1, and the transfer portion 10 is arranged in a position intersecting the second card transport path P2, so the printing apparatus 1 does not have an elongated shape, and has a design freedom while reducing the size.

Further, in the printing apparatus 1, at the intersecting point X1 of the first card transport path P1 and the second card transport path P2, the first turning portion 6 that rotates or inverts the card 'C' is arranged. At the intersecting point X2 of the first card transport path P1 and the third card transport path P3, the second turning portion 5 that rotates or inverts the card 'C' is arranged. Thus, it is possible to switch the transport direction of the card 'C' using these turning portions, thereby enabling the transport path of the card 'C' to fit into the compact space of the entire printing apparatus 1.

The first turning portion 6 sends the card 'C' to the first card transport path P1 and the second card transport path P2, and accepts the card 'C' between the first card transport path P1 and the second card transport path P2. The second turning portion 5 accepts the recoding medium between the information recording portion 8 that records information onto the card 'C'. The first turning portion 6 and second turning portion 5 are connected in the vertical direction so the recording medium can be transported in a compact space without any decrease in transport performance. Because the image forming portion 9 is disposed above the first turning portion 6, the transfer portion 10 is disposed to a side, and the information recording portion 8 is disposed below the transfer portion 10, it is possible to arrange the configuring members of the printing apparatus 1 in a compact space.

Furthermore, since the printing apparatus 1 is equipped with the discharge outlet 27 at the end portion of the second card transport path P2, after transferring the intermediate transfer sheet 'F' or the hologram sheet 'H' to the card 'C' at the transfer portion 10, the card 'C' can be discharged as is, thus enabling a shorter transport path of the printing apparatus 1. The eject outlet 28 is disposed for ejecting the defective card 'C' having erroneous data detected at the information recording portion 8. The second turning portion 5 rotates the defective card 'C' and ejects it from the printing apparatus through the eject outlet 28, thus no transport path for transporting the defective card 'C' is necessary, further reducing the size of the printing apparatus 1.

It is shown that the printing apparatus 1 according to the present embodiment has the magnetic encoder and the contact type IC writer/reader device as the information recording portion 8. However, but it is also possible to employ a non-contact type antenna to electrically read and write to an IC chip embedded in the card, if a non-contact type IC card is used. To selectively perform magnetic recording and electrical recording, it is acceptable to arrange an IC writer, etc., between the second turning portion 5 and the eject outlet 28, and to arrange another turning portion between the second turning portion 5 and the information recording portion 8 as well as a recording portion at 90° angles for the two types of information. It is important to note that normally to write information with a magnetic encoder requires one or a plurality of reciprocal transports to the information writing/reading head to magnetically write the data and to verify its correctness, but the transport of the card can be handled by the rotation or the reverse drive of a plurality of transport rollers in the information recording portion.

Furthermore, according to this embodiment of the invention, the first turning portion 6 and the second turning portion 5 are synchronized (interlocked) to rotate or invert, but these turning portions can also independently rotate or invert. Further, according to the embodiment of the present invention, the rotating frame 40 and the pinch rollers 38, 39 are independently driven. However, to prevent any offset of the card, it is acceptable to rotate the pinch rollers 38, 39 in reverse the same amount of angle as the rotating frame 40.

According to the embodiment of the present invention, the first card transport path P1 is formed substantially vertically where the image forming portion 9 is arranged, and the second card transport path P2 is formed substantially horizontally where the transfer portion 10 is arranged. However, it is also conceivable to form the first card transport path P1 substantially horizontally and the second card transport path P2 substantially vertically. In such a situation, the arrangement of the first turning portion 6 and the second turning portion 5 can be slightly altered so that the image forming portion 9 and transfer portion 10 are arranged at 90 degree angle for the printing apparatus to attain the same effect as the present embodiment.

Further, the present embodiment teaches covering the card 'C' with a hologram sheet 'H', however it is also acceptable to use only a simple coating film to cover the card 'C' without hologram instead the hologram sheet 'H'. Using the hologram sheet 'H' to cover the surface of the card 'C' enhances the security of the card 'C', however a similar protection to the hologram sheet 'H' can be attained with a coating film having a receptive layer formed directly on the card 'C'.

Furthermore, this embodiment of the present invention teaches manually replacing the intermediate transfer sheet 'F' and the hologram sheet 'H', however, it is also acceptable to employ a well known technology to electrically switch them on the same shaft. In this case, it is acceptable to arrange the intermediate transfer sheet take-up portion 17 and the hologram sheet take-up portion 30, and the intermediate transfer sheet supply portion 16 and hologram sheet supply portion 29 onto each of the take-up spool shaft 110 and the supply spool shaft 120. It is also acceptable to arrange the intermediate transfer sheet take-up portion 17 and the hologram sheet take-up portion 30 only onto the same shaft of the take-up spool shaft 110 and to mount the intermediate transfer sheet supply portion 16 and the hologram sheet supply portion 29 on separate spool shafts. Conversely, it is acceptable to arrange only the intermediate transfer sheet supply portion 16 and the hologram sheet supply portion 29 on the same shaft as the supply spool shaft 120 and to mount the intermediate transfer sheet take-up portion 17 and the hologram sheet take-up portion 30 on separate spool shafts.

Again, in the present embodiment of the invention, it is shown to position the card 'C' using the unit transmission sensor to form the image by layering three colors when directly transferring to both surfaces of a card medium. However, as described in the indirect transfer method, it is also acceptable to dispose the clock plate on the capstan roller 78, for example, and to use a unit transmission sensor to detect the rotation amount of the clock plate.

According to the present embodiment of the invention, it is shown to print to the front side of the card 'C' first in the direct transfer method to print to both sides of the card 'C', but it is also possible to print to the back side first. In the two operations described above for the present embodiment, an example without overcoat of the intermediate transfer sheet 'F' and the hologram sheet 'H' has not been shown, however it is acceptable to not employ the thermal process at the transfer portion 10 and to discharge the card 'C' as is with no overcoat. Further, in the present embodiment of the invention, it is disclosed that a pair of the rollers on the second card transport path P2 rotate only in the arrow direction 'L' in FIG. 1. However if it is possible to transport in the arrow direction 'R', the card can be covered with the hologram sheet 'H' after directly printing to the front side, and then the card can be reversed to the arrow direction 'R' to be directly printed on the backside and subsequently discharged. In the same way, when directly and indirectly transferring the image, although the example where the indirect transfer occurs after the operations is shown, it is also acceptable to perform the indirect transfer first followed by the direct transfer.

Figure 8:
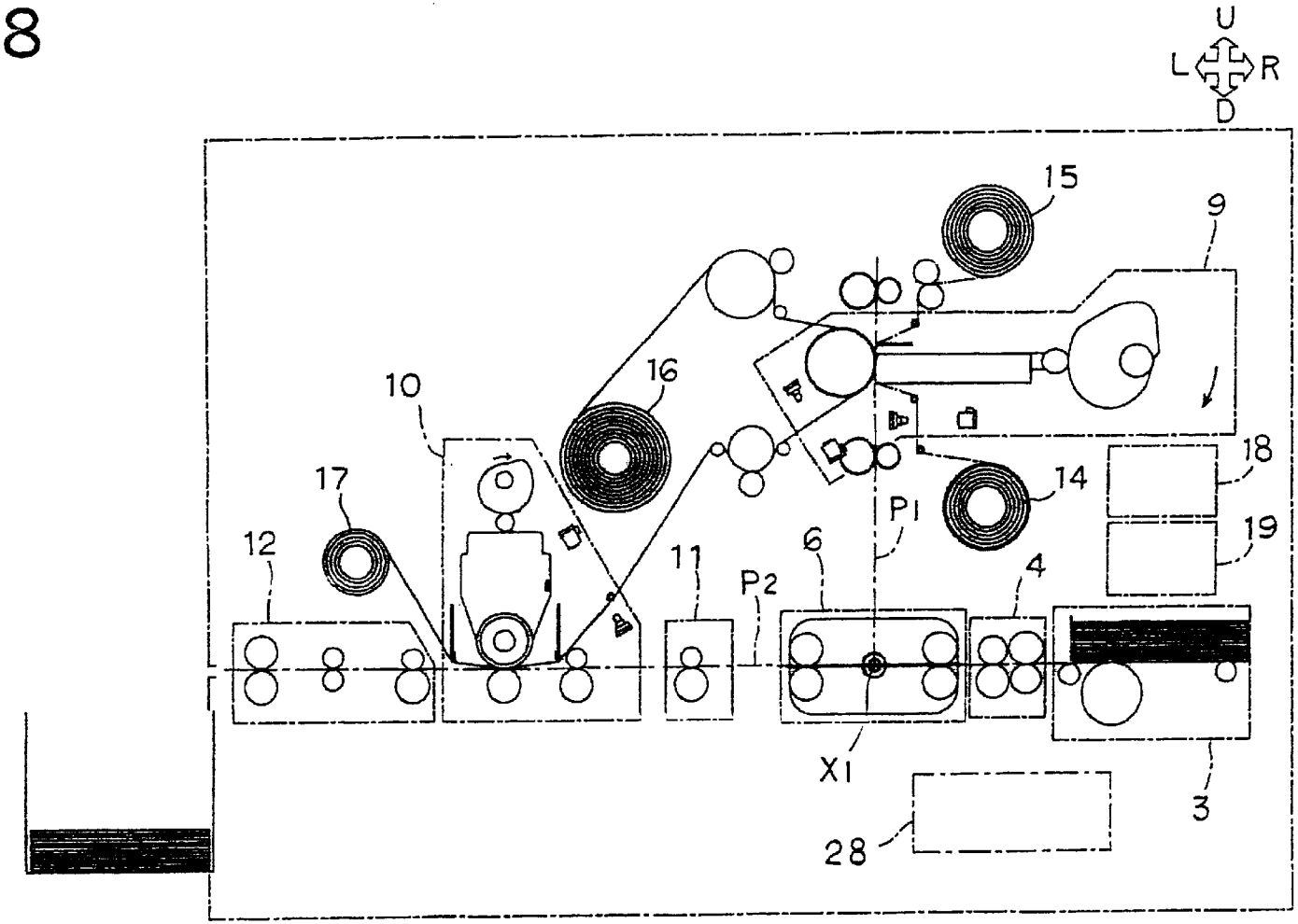
FIG. 8 is a side view showing a general configuration of an embodiment of the present invention.

Also disclosed in this embodiment of the present invention is the information recording portion 8 built-in to the printing apparatus 1. However, as shown in FIG. 8, if the information recording to the card 'C' is performed outside the printing apparatus 1, or cards do not require such recording, it will not be necessary to dispose the second turning portion 5 and the information recording portion 8 inside the printing apparatus 1 if the cleaner 4 is disposed upstream of the first turning portion 6 and the card supply portion 3 even further upstream. Thus, while it is possible to have such an arrangement as an option for the printing apparatus 1, it would also help to reduce the size of the printing apparatus by eliminating the second turning portion 5 and the information recording portion 8.

As described above, according to this invention, the printing apparatus has at least one printing means to selectively form the images on the recording medium or the intermediate transfer medium, and the transfer means to transfer the image on an intermediate transfer medium to the recording medium. Thus, it is possible to print by switching between the direct transfer method and the indirect transfer method. Further, the recoding medium is transported while turning at an turning portion to the first recording media transport path comprising at least one printing means and to the second recording media transport path comprising a transfer means, thus it is possible to have a compact apparatus without becoming elongated whiling maintaining the design freedom.

While the invention has been explained with reference to the specific embodiments of the invention, the explanation is illustrative and the invention is limited only by the appended claims.

What is claimed is:

1. A printing apparatus for printing an image on a recording medium, comprising:

a first recording media transport path for transporting the recording medium, at least one printing means disposed on the first recording media transport path for printing the image selectively to the recording medium and an intermediate transfer medium;

a second recording media transport path connected to the first recording media transport path for transporting the recording medium, transfer means disposed on the second recording media transport path for transfer the image formed on the intermediate transfer medium to the recording medium; and a turning portion disposed between the first recording media transport path and the second recording media transport path for supporting and transporting the recording medium therebetween.

2. A printing apparatus according to claim 1, wherein said first recording media transport path and said second recording media transport path are arranged to intersect, and said turning portion is arranged at the intersecting point thereof.

3. A printing apparatus according to claim 2, wherein said first recording media transport path and said second recording media transport path are arranged perpendicular to each other.

4. A printing apparatus according to claim 2, wherein one of said first recording media transport path and said second recording media transport path is arranged substantially horizontally and the other is arranged substantially vertically.

5. A printing apparatus according to claim 2, further comprising a recording medium discharge outlet disposed at an end portion of the second recording media transport path for discharge the recording medium.

6. A printing apparatus according to claim 2, wherein said printing means is arranged above the turning portion, and said transfer means is arranged on a side of the turning portion.

7. A printing apparatus according to claim 2, further comprising an encoder portion for recording information to the recording medium, said turning portion sending and receiving the recording medium between the first recording media transport path and the second recording media transport path, and sending and receiving the recording medium relative to the encoder portion.

8. A printing apparatus according to claim 6, further comprising an eject outlet for ejecting the recording medium having processing errors detected at the encoder portion, said turning portion rotating and sending the recording medium having the processing errors to be discharged through the eject outlet.

9. A printing apparatus according to claim 7, wherein said turning portion comprises a first turning member and a second turning member for rotating and inverting the recording medium, one of said first and second turning members sending and receiving the recording medium between the first recording media transport path and the second recording media transport path, and the other of the first and second tuning members sending and receiving the recording medium relative to the encoder portion.

10. A printing apparatus according to claim 7, wherein said first turning member and said second turning member are connected in a vertical direction, said printing means is disposed above the turning members, and said transfer means is disposed on a side of at least one of the first turning member and the second turning member.

11. A printing apparatus according to claim 7, wherein said encoder portion is arranged below the transfer means.

12. A printing apparatus according to claim 10, wherein said encoder portion is arranged below the transfer means.

* * * * *